US009316448B2

(12) United States Patent
Kanzaka et al.

(10) Patent No.: US 9,316,448 B2
(45) Date of Patent: Apr. 19, 2016

(54) VEHICLE HEAT EXCHANGER

(75) Inventors: Ryuji Kanzaka, Miyoshi (JP); Tadasu Tomohiro, Toyota (JP); Kazumichi Sasaki, Toyota (JP); Shozo Fuji, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 241 days.

(21) Appl. No.: 13/295,421

(22) Filed: Nov. 14, 2011

(65) Prior Publication Data

US 2012/0118542 A1 May 17, 2012

(30) Foreign Application Priority Data

Nov. 15, 2010 (JP) ..... 2010-255424

(51) Int. Cl.

*F28F 3/02* (2006.01)
*F28D 9/00* (2006.01)
*F28D 21/00* (2006.01)

(52) U.S. Cl.

CPC ..... *F28F 3/025* (2013.01); *F28D 9/005* (2013.01); *F01P 2060/045* (2013.01); *F01P 2060/08* (2013.01); *F28D 2021/008* (2013.01)

(58) Field of Classification Search

CPC ..... F28F 3/04; F28F 3/042; F28F 3/044; F28F 3/046; F28F 3/048; F28F 2275/04; F28D 9/0005
USPC ..... 165/166, 167
See application file for complete search history.

(56) References Cited

U.S. PATENT DOCUMENTS

| | | | | |
|---|---|---|---|---|
| 2,596,008 | A * | 5/1952 | Collins | 165/167 |
| 5,099,912 | A | 3/1992 | Tajima et al. | |
| 5,931,219 | A | 8/1999 | Kull et al. | |
| 6,182,746 | B1 * | 2/2001 | Wiese | 165/166 |
| 2002/0066552 | A1 | 6/2002 | Komoda | |
| 2005/0241814 | A1 | 11/2005 | Hendrix et al. | |

(Continued)

FOREIGN PATENT DOCUMENTS

| | | | |
|---|---|---|---|
| CN | 1653309 | A | 8/2005 |
| DE | 19511991 | A1 | 10/1996 |
| JP | 50-123958 | U | 3/1974 |

(Continued)

OTHER PUBLICATIONS

Partial English translation of Japanese Office Action for corresponding JP Patent Application No. JP 2010-255424 issued on Oct. 2, 2012.

*Primary Examiner* — Mohammad M Ali
*Assistant Examiner* — John Higgins
(74) *Attorney, Agent, or Firm* — Sughrue Mion, PLLC

(57) ABSTRACT

A vehicle heat exchanger includes a plurality of cup plates that are formed such that a first layered space into which a first heat carrier is introduced and a second layered space into which a second heat carrier is introduced are formed alternately between the plurality of cup plates when the plurality of plates are stacked. Peripheral end portions of the plurality of cup plates are fixed together in a liquid-tight manner. A distance in a stacking direction from a first cup plate that forms the first layered space to a second cup plate that forms the second layered space and a distance in the stacking direction from the second cup plate to the first cup plate are set to different distances, and end portions of outer wall portions of the cup plates are bent back so as to be apart from each other when the cup plates are stacked.

3 Claims, 3 Drawing Sheets

(56) References Cited

U.S. PATENT DOCUMENTS

| | | | | |
|---|---|---|---|---|
| 2010/0059215 | A1* | 3/2010 | Kolb et al. | 165/152 |
| 2011/0011568 | A1* | 1/2011 | Han et al. | 165/133 |

FOREIGN PATENT DOCUMENTS

| | | | |
|---|---|---|---|
| JP | 63-159675 | U | 10/1988 |
| JP | 5-1890 | A | 1/1993 |
| JP | 6-22770 | U | 3/1994 |
| JP | 09-166391 | A | 6/1997 |
| JP | 09-217992 | A | 8/1997 |
| JP | 10-300382 | A | 11/1998 |
| JP | 2000-283661 | A | 10/2000 |
| JP | 2002-168591 | A | 6/2002 |
| JP | 2003-286846 | A | 10/2003 |
| JP | 2005-530979 | A | 10/2005 |
| JP | 2007-278612 | A | 10/2007 |
| WO | 2004/001315 | A1 | 12/2003 |

* cited by examiner

VEHICLE HEAT EXCHANGER

INCORPORATION BY REFERENCE

The disclosure of Japanese Patent Application No. 2010-255424 filed on Nov. 15, 2010 including the specification, drawings and abstract is incorporated herein by reference in its entirety.

BACKGROUND OF THE INVENTION

1. Field of the Invention

The invention relates to a stacked vehicle heat exchanger that performs heat exchange between a first heat carrier and a second heat carrier.

2. Description of Related Art

Stacked heat exchangers are well known. The stacked heat exchangers described in Japanese Patent Application Publication No. 10-300382 (JP-A-10-300382), Japanese Patent Application Publication No. 9-217992 (JP-A-9-217992), and Japanese Patent Application Publication No. 9-166391 (JP-A-9-166391) are examples. JP-A-10-300382, JP-A-9-217992, and JP-A-9-166391 describe stacked heat exchangers in which fluid (a heat carrier, a heat exchanging medium) passage tubes are formed in multiple stages by a stacked structure of thin metal plates. JP-A-10-300382, JP-A-9-217992, and JP-A-9-166391 also propose technology for discovering brazing defects in a joint portion through inspection, or technology for reliably (or easily) checking wrong assembly, and the like.

A stacked vehicle heat exchanger (such as a transmission fluid cooler) has also been proposed that has thin metal dish-shaped plates (i.e., a cup plates), of which the peripheral edge portions are fixed in a liquid-tight manner when stacked, formed such that a first layered space into which a first heat carrier (such as transmission fluid) is introduced and a second layered space into which a second heat carrier (such as coolant) is introduced, are formed alternately between them. This stacked vehicle heat exchanger performs heat exchange between the first heat carrier and the second heat carrier. In this kind of vehicle heat exchanger, inner fins are provided between the cup plates (i.e., in the layered spaces) in order to improve heat-transfer performance and ensure strength, for example. Also, a vehicle heat exchanger is manufactured by a core of the heat exchanger being formed by these cup plates and inner fins being alternately stacked together in order, and then being integrally brazed in a liquid-tight manner in a brazing furnace. Also, with this kind of vehicle heat exchanger as well, it is desirable to reduce wrong assembly, just as with the stacked heat exchangers described in JP-A-10-300382, JP-A-9-217992, and JP-A-9-166391. It is also desirable to improve cooling performance. In this way, there is room for improvement with regards to reducing wrong assembly and defects, and more reliably (or easily) performing an inspection for reducing wrong-assembly and defects. There is also room for improvement with regards to improving cooling performance and size reduction due to improved cooling performance. These issues are not well-known.

SUMMARY OF THE INVENTION

The invention provides a vehicle heat exchanger that can reliably reduce wrong assembly, and that can be made small.

A first aspect of the invention relates to a vehicle heat exchanger. This heat exchanger includes a plurality of cup plates that are formed such that a first layered space into which a first heat carrier is introduced and a second layered space into which a second heat carrier is introduced are formed alternately between the plurality of cup plates when the plurality of plates are stacked, and in which peripheral end portions of the plurality of cup plates are fixed together in a liquid-tight manner. The heat exchanger performs heat exchange between the first heat carrier and the second heat carrier. Also, a distance in a stacking direction between a first cup plate, which is one of the plurality of cup plates, and a second cup plate, which is another one of the plurality of cup plates, and a distance in the stacking direction between the second cup plate and another first cup plate, which is another one of the plurality of cup plates, are set to different distances, the first cup plate and the second cup plate forming the first layered space, the second cup plate and the another first cup plate forming the second layered space; and end portions of outer wall portions of the cup plates are bent back so as to be apart from each other when the cup plates are stacked.

Accordingly, the distance in the stacking direction from the cup plate that forms the first layered space to the second cup plate that forms the second layered space and the distance in the stacking direction from the second cup plate to the first cup plate are set to different distances, and the end portions of the outer wall portions of the cup plates are bent back so that they are apart from each other when the cup plates are stacked. As a result, it is possible to reduce the number of cases in which the first cup plate and second cup plate are wrongly assembled or missing. For example, it is easier to check for a wrongly assembled or missing first cup plate and second cup plate by visually inspecting the exterior, than it is when the distances described above are set to the same distance. Also, when the vehicle heat exchanger is manufactured by forming the core of the heat exchanger by alternately stacking the cup plates in order, and then brazing them together in a liquid-tight manner in a brazing furnace, for example, the number of cases in which the first cup plate and the second cup plate are wrongly assembled or missing can be reduced by visually inspecting the exterior, without performing a complete inspection (for example, an inspection for heat carrier leaks) after manufacturing. In particular, when the entire outer wall portions of the cup plates are fixed together by brazing the cup plates that have braze layers formed on the surfaces, it may be difficult to perform a visual inspection of the exterior after brazing because the end portions of the outer wall portions are covered by brazing filler material. In contrast, the end portions of the outer wall portions of the cup plates are bent back so that they are apart from each other when the cup plates are stacked, so a visual inspection of the exterior after brazing can be performed easily. Also, wrong assembly and missing parts after brazing (after completion) can be reduced by visually inspecting the exterior prior to brazing, for example.

A second aspect of the invention relates to a vehicle heat exchanger. This heat exchanger includes a plurality of cup plates that are formed such that a first layered space into which transmission fluid is introduced and a second layered space into which coolant is introduced are formed alternately between the plurality of cup plates when the plurality of plates are stacked, and in which peripheral end portions of the plurality of cup plates are fixed together in a liquid-tight manner. The heat exchanger performs heat exchange between the transmission fluid and the coolant. A fin that abuts against each of the first cup plate that forms the first layered space that introduces the transmission fluid and a second cup plate that forms the second layered space that introduces the coolant is provided inside the first layered space. A convex protrusion that protrudes out on the second layered space side and that abuts against the first cup plate is formed on the second cup plate. Also, a height of the convex protrusion is set to a value smaller than a height in a stacking direction of the fin.

A third aspect of the invention relates to a vehicle heat exchanger. This heat exchanger includes a plurality of first cup plates and a plurality of second cup plates. The plurality of first cup plates and the plurality of second cup plates are alternately stacked. A distance in a stacking direction between one of the first cup plates and one of the second cup plates that is adjacent to the one of the first cup plates and a distance in the stacking direction between the one of the second cup plates and another one of the first cup plates that is adjacent to the one of the second cup plates and is disposed on a side opposite to the one of the first cup plates in the stacking direction with respect to the one of the second cup plates are set to different distances. And end portions of outer wall portions of the cup plates are bent back so as to be apart from each other when the cup plates are stacked.

Accordingly, the height in the stacking direction of the convex protrusion is set to a smaller value than the height in the stacking direction of the fin. Therefore, compared with when the fin is provided inside the second layered space just as it is in the first layered space, the height in the stacking direction of the vehicle heat exchanger for transmission fluid (i.e., the transmission fluid cooler) can be reduced and the vehicle heat exchanger can be made that much smaller. For example, with a transmission fluid cooler, the heat-exchange capability does not have to be high as it does with a heat exchanger for engine oil (i.e., an engine oil cooler). That is, not as much coolant needs to be circulated to the transmission side, so the flow path (i.e., the second layered space) for the coolant can be narrower than the flow path (i.e., the first layered space) for the transmission fluid, and the convex protrusion is used instead of the fin, so the transmission fluid cooler can be made that much smaller. Further, because the convex protrusion is used instead of the fin, if the heat-exchange capability (i.e., heat-exchange performance and heat-transfer performance) is equivalent, the height of the convex protrusion can be set to a smaller value than the height in the stacking direction of the fin, so the transmission fluid cooler can made smaller while ensuring the strength.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

In the invention, the transmission fluid is preferably hydraulic fluid (transmission fluid) that can be used in a vehicular automatic transmission, for example. More specifically, this hydraulic fluid may be, for example, well-known hydraulic fluid (ATF: Automatic Transmission Fluid) used in a planetary gear type automatic transmission or a synchronous mesh twin shaft parallel axis-type automatic transmission or the like, well-known hydraulic fluid (CVTF) used in a belt-type continuously variable transmission (belt-type CVT) or a traction-type continuously variable transmission, well-known hydraulic fluid used in an automatic transmission for a hybrid vehicle that functions as a so-called electric continuously variable transmission that includes a differential mechanism and an electric motor, or well-known hydraulic fluid used in an automatic transmission mounted in a so-called parallel hybrid vehicle that includes an electric motor capable to transmitting power to an engine shaft and an output shaft or the like.

Also, the coolant is preferably coolant that can be used to cool an internal combustion engine such as a gasoline engine or a diesel engine, for example, and that is cooled by heat exchange being performed with the outside air by a well-known radiator.

Hereinafter, example embodiments of the invention will be described in detail with reference to the accompanying drawings.

Figure 1:
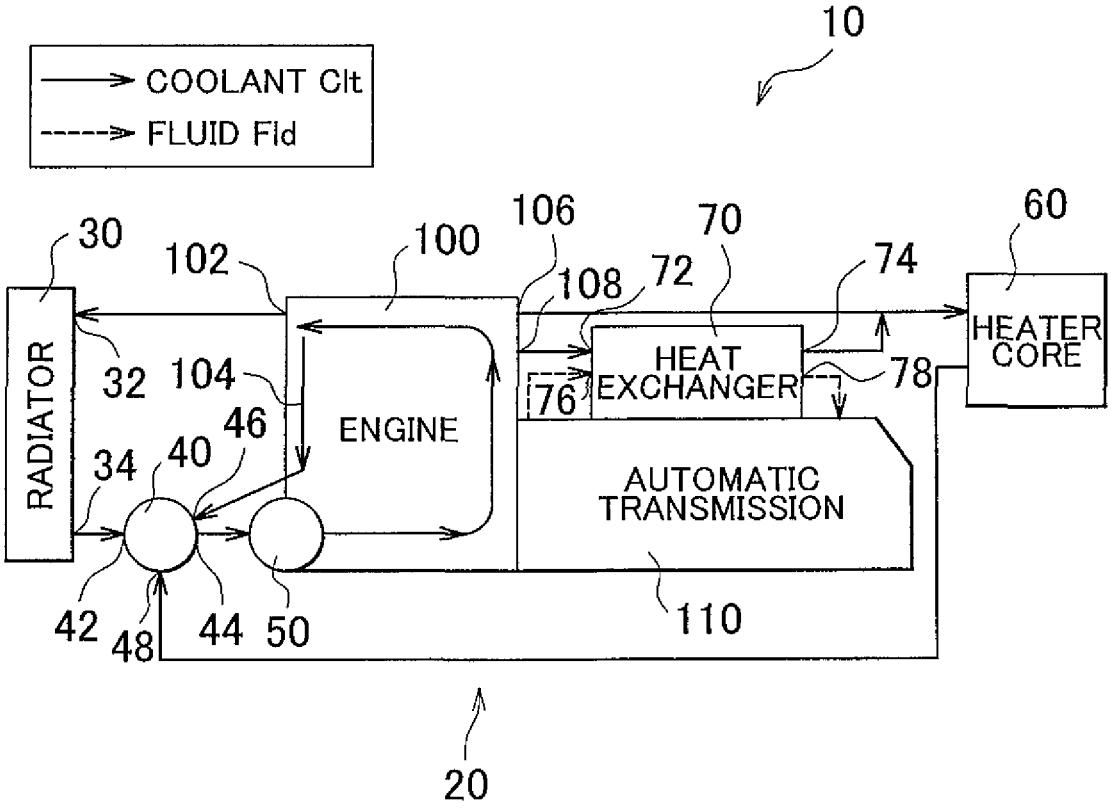
FIG. 1 is an example of a block diagram schematically showing the structure of a cooling system provided in a vehicle.

FIG. 1 is a block diagram schematically showing the structure of a cooling system 20 provided in a vehicle 10. In FIG. 1, the cooling system 20 includes, for example, a radiator 30, a thermostat 40, a water pump 50, a heater core 60, and a vehicle heat exchanger (hereinafter, referred to as "heat exchanger") 70 to which the invention may be applied. The solid arrows in FIG. 1 indicate the flow of coolant Clt, and the broken arrows indicate the flow of transmission fluid Fld (hereinafter, referred to as "fluid Fld").

The radiator 30 receives coolant Clt for an engine 100 that flows out from an outlet 102 of a water jacket of the engine 100 mounted in the vehicle 10, cools the coolant Clt through heat exchange with outside air, and discharges the cooled coolant Clt out from an outlet 34 into an inlet 42 of the thermostat 40.

Until the coolant Clt becomes equal to or greater than a predetermined temperature, for example, the thermostat 40 closes a value on the inlet 42 side to prevent the coolant Clt from flowing from the inlet 42 to an outlet 44. On the other hand, when the coolant Clt becomes equal to or greater than the predetermined temperature, for example, the thermostat 40 opens the valve on the inlet 42 side to allow the coolant Clt to flow from the inlet 42 to the outlet 44, from which the coolant Clt then flows out to the water pump 50. Also, the thermostat 40 receives, from an inlet 46, coolant Clt that flows through a bypass flow path 104 in the water jacket of the engine 100, and channels this coolant Clt from the outlet 44 to the water pump 50. Also, the thermostat 40 receives, from an inlet 48, coolant Clt that flows through the heater core 60, and channels this coolant Clt from the outlet 44 to the water pump 50.

The water pump 50 is provided in the engine 100, for example, and draws in coolant Clt via the thermostat 40 and supplies it to the water jacket of the engine 100 that channels the coolant Clt to various parts.

The heater core 60 receives coolant Clt that flows out from an outlet 106 of the water jacket of the engine 100, and performs heat exchange between this coolant Clt and air, thereby generating warm air.

The heat exchanger 70 includes a coolant inlet 72 that receives coolant Clt that flows out from an outlet 108 of the water jacket of the engine 100, a coolant outlet 74 that channels the coolant Clt to the heater core 60 after it flows through the inside of the heat exchanger 70 itself, a fluid inlet 76 that receives fluid Fld that flows out from a vehicular automatic transmission (hereinafter, referred to as "automatic transmission") 110, and a fluid outlet 78 that channels this fluid Fld to the automatic transmission 110 after it flows though the inside of the heat exchanger 70 itself. The heat exchanger 70 structured in this way performs heat exchange between the fluid Fld that serves as a first heat carrier that is received from the fluid inlet 76, and the coolant Clt that serves as a second heat carrier that is received from the coolant inlet 72. That is, the heat exchanger 70 is a heat exchanger for transmission fluid, i.e., a transmission fluid cooler, that performs heat exchange between the fluid Fld and the coolant Clt.

With the cooling system 20 structured in this way, the coolant Clt that flows out from the water jacket of the engine 100, for example, is returned to the water jacket by the water pump 50 through the heater core 60 and the heat exchanger 70. Also, for example, when the valve of the thermostat 40 is closed, the coolant Clt that flows out from the water jacket of the engine 100 flows through the bypass flow path 104 and is returned to the water jacket by the water pump 50. In addition, for example, when the valve of the thermostat 40 is open, the coolant Clt that flows out from the water jacket of the engine 100 flows through the radiator 30 and is returned to the water jacket by the water pump 50.

Also, in the heat exchanger 70, for example, when it is cold (during warm-up), heat is transferred from coolant Cit that has been warmed by the engine 100 to the fluid Fld, so that the fluid Fld is warmed quickly, which in turn promotes warm-up of the automatic transmission 110, thereby improving fuel efficiency. On the other hand, after warm-up, heat is transferred to the coolant Clt fluid Fld that has been warmed by the automatic transmission 110, so the fluid Fid is cooled, and thus, the automatic transmission 110 is cooled.

Figure 2:
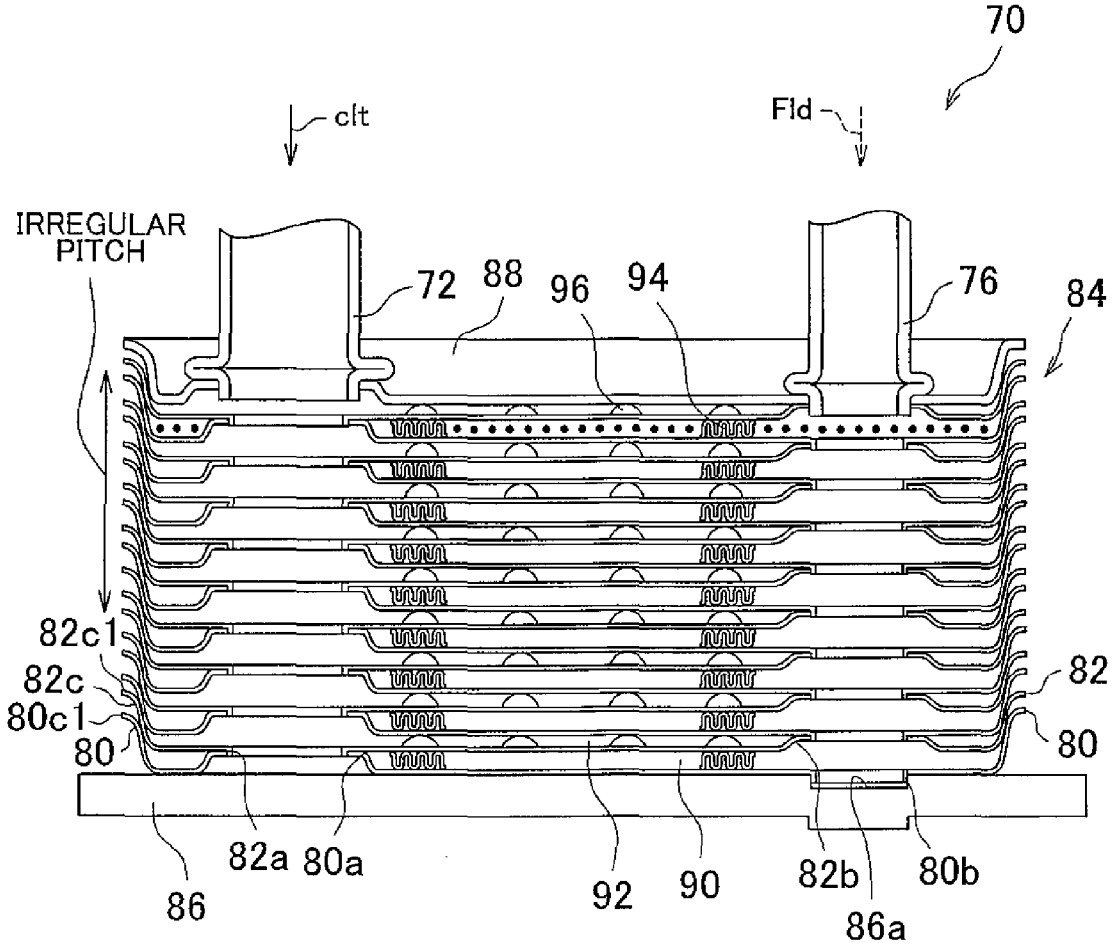
FIG. 2 is a sectional view of a heat exchanger shown in FIG. 1.

FIG. 2 is a sectional view of the heat exchanger 70. In FIG. 2, the heat exchanger 70 includes, in addition to the coolant inlet 72, the coolant outlet 74, the fluid inlet 76, and the fluid outlet 78 described above, fluid side cup plates 80 that serve as first cup plates, coolant side cup plates 82 that serve as second cup plates, a base plate 86 that serves as an end plate that abuts against a cup plate (for example, the fluid side cup plate 80) on one side in the stacking direction of a core main body 84 formed by a stack of fluid side cup plates 80 and coolant side cup plates 82, and a top plate 88 that serves as an end plate that abuts against a cup plate (for example, a coolant side cup plate 82) on the other side in the stacking direction of the core main body 84. The fluid side cup plates 80, the coolant side cup plates 82, and the top plate 88 are each formed by a thin metal plate. Also, the base plate 86 is a thick metal plate (for example, an aluminum plate that is sufficiently thicker than the fluid side cup plates 80) that serves as the base when the fluid side cup plates 80 and the coolant side cup plates 82 are stacked in order. This base plate 86 functions as a strengthening member for mounting the heat exchanger 70 to the vehicle 10 (for example, to the automatic transmission 110). In FIG. 2, for the sake of convenience, the cross-section passing through the center of the coolant inlet 72 and the cross-section passing through the center of the fluid inlet 76 are shown on the same plane. Also, the coolant outlet 74 and the fluid outlet 78 are provided on the surface of the top plate 88, just like the coolant inlet 72 and the fluid inlet 76. Alternatively, the coolant outlet 74 and the fluid outlet 78 may be provided on the surface of the base plate 86.

In the fluid side cup plates 80, coolant flow hole portions 80*a* that allow the coolant Clt to flow and correspond to the coolant inlet 72 and the coolant outlet 74, and fluid flow hole portions 80*b* that allow the fluid Fid to flow and correspond to the fluid inlet 76 and the fluid outlet 78, are formed in an aluminum plate that is approximately 0.2 mm to 0.5 mm thick, for example, by press-forming. Also, in the coolant side cup plates 82, coolant flow hole portions 82*a* that allow the coolant Clt to flow and correspond to the coolant inlet 72 and the coolant outlet 74, and fluid flow hole portions 82*b* that allow the fluid Fld to flow and correspond to the fluid inlet 76 and the fluid outlet 78, are formed in an aluminum plate that is approximately 0.2 mm to 0.5 mm thick, for example, by press-forming.

Also, the plurality of fluid side cup plates 80 and coolant side cup plates 82 with braze layers formed on their surfaces are formed (i.e., assembled) in a stacked manner such that fluid flow layered spaces (hereinafter, referred to as "fluid flow layers") 90 that serve as first layered spaces into which the fluid Fld is introduced, and coolant flow layered spaces (hereinafter, referred to as "coolant flow layers") 92 that serve as second layered spaces into which the coolant Clt is introduced, are formed alternately between them. The plurality of fluid side cup plates 80 and coolant side cup plates 82 are fixed together in a liquid-tight manner at their peripheral edge portions by brazing. That is, the fluid side cup plates 80 form the fluid flow layers 90 and the coolant side cup plates 82 form the coolant flow layers 92, by the fluid side cup plates 80 and the fluid flow layers 90 being alternately stacked together. The fluid flow layers 90 are also flow paths (i.e., passages) for the fluid Fld, and the coolant flow layers 92 are also flow paths for the coolant Clt, so the heat exchanger 70 is a stacked vehicle heat exchanger that performs heat exchange between the fluid Fld in the fluid flow layers 90 and the coolant Clt in the coolant flow layers 92. Therefore, the coolant flow hole portions 80*a*, the fluid flow hole portions 80*b*, the coolant flow hole portions 82*a*, and the fluid flow hole portions 82*b* are formed in predetermined shapes such that the stacked plates are brazed together in a liquid-tight manner, while serving as positioning holes when alternately stacking the fluid side cup plates 80 and the coolant side cup plates 82, together. For example, annular protrusions that are the inner peripheral edges of the fluid flow hole portions 80*b* and are burred so as to protrude out toward the coolant side cup plate 82 side are brazed in a liquid-tight manner while fit into the fluid flow hole portions 82*b* on which flange portions that protrude out toward the fluid side cup plates 80 are formed. Also, annular protrusions that are the inner peripheral edges of the coolant flow hole portions 82*a* and are burred so as to protrude out toward the fluid side cup plates 80 are brazed in a liquid-tight manner while fit into the coolant flow hole portions 80*a* on which flange portions that protrude out toward the coolant side cup plates 82 are formed. Further, the fluid flow hole portions 80*b* also serve as positioning holes when stacking the fluid side cup plates 80 onto the base plate 86. Therefore, positioning recessed portions 86*a* corresponding to the fluid flow hole portions 80*b* (i.e., the annular protrusions) are formed by press-forming, for example, in the base plate 86, such that the annular protrusions burred on the fluid flow hole portions 80*b* fit into the base plate 86.

Inner fins 94 that serve as fins that abut against the fluid side cup plates 80 and the coolant side cup plates 82 are provided across the entire fluid flow layers 90, inside the fluid flow layers 90. Also, a plurality of individual convex protrusions 96 that protrude out toward the coolant flow layers 92 and abut against the fluid side cup plates 80 are formed at approximately equal density, for example, on the coolant side cup plates 82. The inner fins 94 and the convex protrusions 96 are both provided to improve heat-transfer performance during heat exchange performed between the fluid FId and the coolant Clt. In this way, the inner fins 94 and the convex protrusions 96 are both structures that perform heat exchange between the fluid Fld and the coolant Clt, but their structures for performing heat exchange are different with the fluid side cup plates 80 and the coolant side cup plates 82. In addition, the fluid side cup plates 80 and the coolant side cup plates 82 are both formed with thin metal plates, so the inner fins 94 and the convex protrusions 96 are both provided to ensure strength with respect to a load in the stacking direction in particular. The convex protrusions 96 are formed by press-forming the coolant side cup plates 82, for example. In other words, the convex protrusions 96 are depressions (i.e., dimples) formed by press-forming the coolant side cup plates 82.

Figure 3:
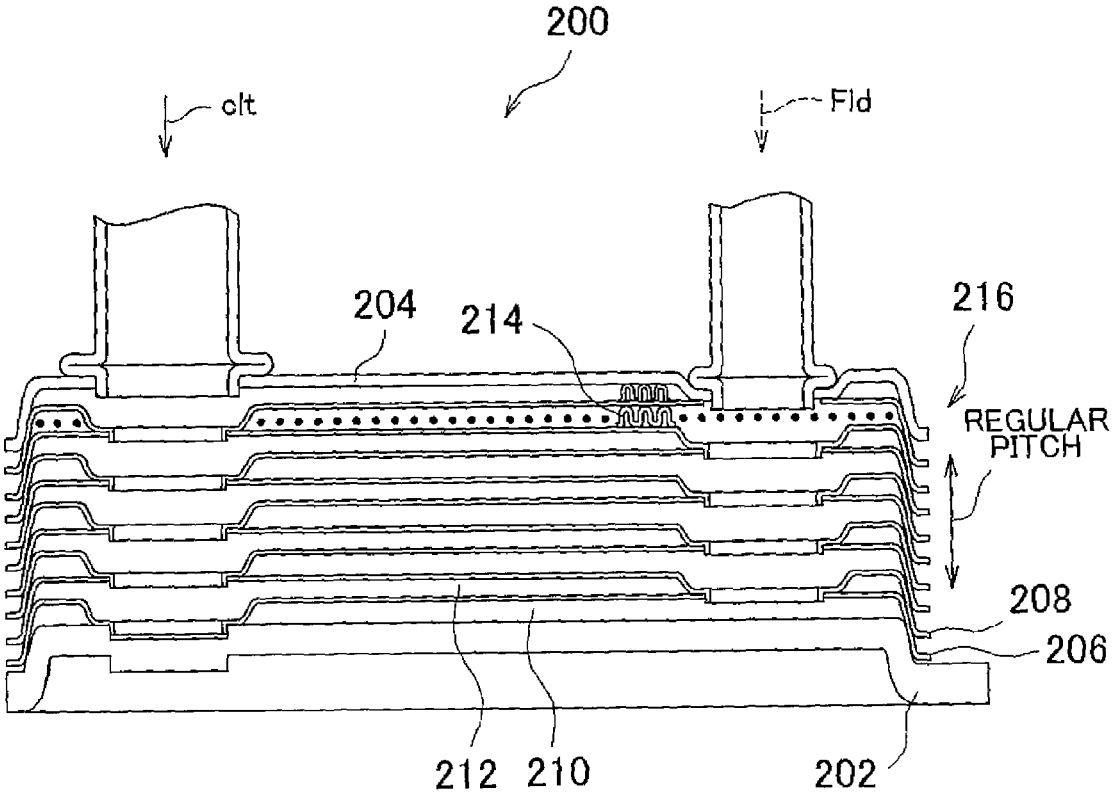
FIG. 3 RELATED ART
FIG. 3 is a sectional view of an example of a heat exchanger according to related art.

Here, a case in which the structure of the inner fins 94 is employed on the fluid side cup plates 80 (in the fluid flow layers 90) and the structure of the convex protrusions 96 is employed on the coolant side cup plates 82 (in the coolant flow layers 92) will be described in detail. FIG. 3 is a sectional view of an example of a heat exchanger 200 according to related art. In this heat exchanger 200, fluid side cup plates 206 and coolant side cup plates 208 are alternately stacked together between a base plate 202 and a top plate 204, such that fluid flow layers 210 and coolant flow layers 212 are alternately formed between them. In the heat exchanger 200, inner fins 214 that abut against the fluid side cup plates 206 and the coolant side cup plates 208 are provided both inside the fluid flow layers 210 and inside the coolant flow layers 212. That is, in the heat exchanger 200, a distance in the stacking direction from the fluid side cup plates 206 to the coolant side cup plates 208 (hereinafter, referred to as the "fluid side P-to-coolant side P distance") and a distance in the stacking direction from the coolant side cup plates 208 to the fluid side cup plates 206 (hereinafter, referred to as the "coolant side P-to-fluid side P distance") are set to substantially the same distance. When a core main portion 216 is viewed from the outside, the plates appear to be stacked at regular pitches. Therefore, if the fluid side cup plates 206 and the coolant side cup plates 208 are assembled wrong or if one of the plates is left out (i.e., missing) when the heat exchanger 200 is assembled, it may not be easy to determine that there is a missing plate or that the fluid side cup plates 206 and the coolant side cup plates 208 are assembled wrong by visual inspection after assembly, for example.

Therefore, in order to make it easier to identify a missing plate or wrong assembly of the plates by visual inspection after assembly, when the core main body 84 is viewed from the outside after assembly, the plates are stacked at irregular pitches, that is, the fluid side P-to-coolant side P distance and the coolant side P-to-fluid side P distance of the fluid side cup plates 80 and the coolant side cup plates 82 are made different distances. Also, the amount of the coolant Clt that flows to the heat exchanger 70 is much less than the amount of the coolant Clt that flows to the radiator 30, for example, so the flowrate of the coolant Clt will not increase that much even if the thickness dimension of the coolant flow layers 92 in the stacking direction is made thicker. Therefore, it is not necessary to make the coolant flow layers 92 thick enough to provide the inner fins 94. Accordingly, from the viewpoint of making the coolant flow layers 92 very thin by not providing the inner fins 94 on the coolant flow layers 92, the structure of the convex protrusions 96 is used instead of the inner fins 94 to ensure the strength and improve the heat-transfer performance with respect to the decrease in strength and the decrease in heat exchange performance due to the lack of inner fins. At this time, even if the structure of the convex protrusions 96 is used instead of the inner fins 94, balance between the fluid side heat release amount Qf and the coolant side heat release amount Qc is able to be ensured just the same. In addition, with a heat exchanger used with fluid Fld of the automatic transmission 110, the heat-exchange capability does not have to be as high as it does with a heat exchanger used with engine oil, for example.

Therefore, in the heat exchanger 70 of this example embodiment, the structure of the convex protrusions 96 is used and the structure of the inner fins 94 is not used, on the coolant side cup plates 82 (in the coolant flow layers 92). Therefore, the height of the convex protrusions 96 (i.e., the dimension of the amount that the coolant flow layers 92 protrude out in the stacking direction from the surface of the flat portion on the coolant flow layers 92 side) corresponding to the thickness dimension in the stacking direction of the coolant flow layers 92 is set to a smaller value than the height in the stacking direction of the inner fins 94 corresponding to the thickness dimension in the stacking direction of the fluid flow layers 90. For example, the height of the convex protrusions 96 (i.e., the thickness of the coolant flow layers 92) is obtained through testing in advance and set taking into account the number and formation positions of the convex protrusions 96, and the heat balance between the fluid side heat release amount Qf and the coolant side heat release amount Qc.

As described above, the fluid flow layers 90 and the coolant flow layers 92 are set to thicknesses with different thickness dimensions in the stacking direction. Also, the shape of the fluid side cup plates 80 and the shape of the coolant side cup plates 82 are formed different from each other, such that the fluid flow layers 90 and the coolant flow layers 92 of different thicknesses are formed (matching each of the different thicknesses, for example). For example, the flange portions where the coolant flow hole portions 80*a* of the fluid side cup plates 80 and the fluid flow hole portions 82*b* of the coolant side cup plates 82, respectively, are formed protrude in the stacking direction corresponding to the fluid flow layers 90 and the coolant flow layers 92, respectively, that have different thicknesses. The thickness dimension of the first layered space is thicker than the thickness dimension of the second layered space. Also, outer wall portions 80*c* of the fluid side cup plates 80 and outer wall portions 82*c* of the coolant side cup plates 82 protrude out in the stacking direction corresponding to the fluid flow layers 90 and the coolant flow layers 92, respectively, that have different thicknesses, while also protruding out the same amount in the stacking direction corresponding to the liquid-tight brazing between the plates when stacked. In this way, the shapes of the fluid side cup plates 80 and the shapes of the coolant side cup plates 82 are formed corresponding to the fluid flow layers 90 and the coolant flow layers 92, respectively, that have different thicknesses, so the heat exchanger 70 of this example embodiment has a structure in which the fluid side P-to-coolant side P distance and the coolant side P-to-fluid side P distance of the fluid side cup plates 80 and the coolant side cup plates 82 are set to different distances.

In the heat exchanger 70, with the base plate 86 as the lowest level, the core main body 84 is formed by stacking the fluid side cup plate 80, the inner fins 94, the coolant flow layer 92, the fluid side cup plate 80, and the inner fins 94, . . . in this order from the base plate 86 upward, and the top plate 88 is stacked on top as the highest level. Also, the heat exchanger 70 is manufactured by brazing these together in a liquid-tight manner in a brazing furnace, for example, and then a complete inspection is performed after manufacturing (for example, an inspection is performed for fluid Fld and coolant Clt leaks). When viewing the exterior of the core main body 84 with the plates from which the core main body 84 is formed in this series of processes in a stacked state, it is easy to determine whether a fluid side cup plates 80, a coolant side cup plates 82, a fluid side cup plates 80, and a coolant side cup plates 82, . . . are stacked, according to whether the plates are stacked at the predetermined irregular pitches. Accordingly, it is possible to easily reduce the number of cases in which the fluid side cup plates 80 and coolant side cup plates 82 are wrongly assembled or missing. Also, a case in which the fluid side cup plates 80 and coolant side cup plates 82 are wrongly assembled or missing can be corrected prior to brazing by visually inspecting the exterior before brazing, for example, which saves the work of needlessly brazing a core main body that has been wrongly assembled or is missing parts. In particular, when the fluid side cup plates 80 and the coolant side cup plates 82 are brazed, it may be difficult to visually inspect the exterior of the core main body 84 after brazing because the end portions of the outer wall portions 80*c* and 82*c* are covered by brazing filler material, if the structure is such that the entire outer wall portions 80*c* and 82*c* of the cup plates 80 and 82, respectively, are fixed together. Therefore, in order to facilitate visual inspection of the exterior, in the heat exchanger 70 of this example embodiment, end portions 80*c*1 of the outer wall portions 80*c* of the fluid side cup plates 80 and end portions 82*c* 1 of the outer wall portions 82*c* of the coolant side cup plates 82 are bent back so that they are apart from each other when stacked. That is, the fluid side cup plates 80 and the coolant side cup plates 82 are formed in shapes that become farther apart from each other from the brazed sealed portion (i.e., the fixed portion) toward the outer peripheral edge of the outer wall portions 80*c* and the outer wall portions 82*c*. As a result, first and second layered spaces are formed between them, and these spaces in between the outer peripheral wall portions can be visually checked properly.

Also, in the heat exchanger 70, the height displacement in the stacking direction with respect to a load applied in the stacking direction of the core main body 84 is thought to be different depending on whether the inner fins 94 are provided and whether the convex protrusions 96 are properly formed, when the core main body 84 has been formed. Therefore, the height displacement in the stacking direction with respect to a predetermined load applied in the stacking direction of the core main body 84, for example, is detected with the plates from which the core main body 84 is formed in this series of processes in a stacked state. Accordingly, missing inner fins 94 and formation defects in the convex protrusions 96 of the coolant side cup plates 82 can be easily identified by the difference in the height displacement. Accordingly, it is possible to reduce the number of cases in which missing inner fins 94 and deformation defects in the convex protrusions 96 of the coolant side cup plates 82 are not caught. In particular, by performing an inspection according to this load before brazing, it is possible to add missing inner fins 94 and replace coolant side cup plates 82 in which there are formation defects in the convex protrusions 96 before brazing, which saves the work of needlessly brazing a core main body that is missing inner fins 94 or in which there are formation defects in the convex protrusions 96. The predetermined load described above is an inspection load obtained through testing beforehand and set such that there will be a difference in the height displacement in the stacking direction, for example.

Also, in the heat exchanger 70, compared with the heat exchanger 200 in FIG. 3, the height in the stacking direction can be reduced and the heat exchanger 70 can be made that much smaller, while ensuring equivalent heat-exchange capability (heat-exchange performance and heat-transfer performance) and strength.

As described above, according to this example embodiment, the distance in the stacking direction from the fluid side cup plates 80 that forms the fluid flow layers 90 to the coolant side cup plates 82 that forms the coolant flow layers 92 (i.e., the fluid side P-to-coolant side P distance) and the distance in the stacking direction from the coolant side cup plates 82 to the fluid side cup plates 80 (i.e., the coolant side P-to-fluid side P distance) are set to different distances, and the end portions 80*c*1 of the outer wall portions 80*c* of the fluid side cup plates 80 and the end portions 82*c*1 of the outer wall portions 82*c* of the coolant side cup plates 82 are bent back so that they are apart from each other when stacked. As a result, it is possible to reduce the number of cases in which the fluid side cup plates 80 and coolant side cup plates 82 are wrongly assembled or missing. For example, it is easier to check for wrongly assembled or missing fluid side cup plates 80 and the coolant side cup plates 82 than it is when the fluid side P-to-coolant side P distance is set to substantially the same distance as the coolant side P-to-fluid side P. Also, when the heat exchanger 70 is manufactured by forming the core main body 84 of the heat exchanger 70 by alternately stacking the fluid side cup plates 80 and the coolant side cup plates 82 in order, and then brazing them together in a liquid-tight manner in a brazing furnace, for example, the number of cases in which the fluid side cup plates 80 and the coolant side cup plates 82 are wrongly assembled or missing can be reduced by visually inspecting the exterior, without performing a complete inspection after manufacturing (for example, an inspection is performed for fluid Fld and coolant Clt leaks). In particular, when the entire outer wall portions of the cup plates are fixed together by brazing the cup plates that have braze layers on their surfaces, it may be difficult to perform a visual inspection of the exterior after brazing because the end portions of the outer wall portions are covered by brazing filler material. In contrast, with this example embodiment, the end portions 80*c*1 and 82*c*1 of the outer wall portions of the cup plates are bent back so that they are apart from each other when stacked, so a visual inspection of the exterior after brazing can be performed easily. Also, wrong assembly and missing parts after brazing (i.e., after completion) can be reduced by visually inspecting the exterior of the core main body 84 prior to brazing, for example.

Also, according to this example embodiment, the thickness dimensions in the stacking direction of the fluid flow layers 90 and the coolant flow layers 92 are set to different thicknesses, and shape the fluid side cup plates 80 and the shape of the coolant side cup plates 82 are formed different from each another so that the fluid flow layers 90 and the coolant flow layers 92 of different thicknesses are formed. As a result, the fluid side P-to-coolant side P distance and the coolant side P-to-fluid side P distance can be appropriately set to different distances.

Also, according to this example embodiment, with the fluid side cup plates 80 and the second cup plates, the structures for performing heat exchange are different. Therefore, the height displacement in the stacking direction with respect to an inspection load applied in the stacking direction can be made different with the fluid side cup plates 80 (the fluid flow layers 90) and the coolant side cup plates 82 (the coolant flow layers 92). As a result, wrongly assembled and missing fluid side cup plates 80 and coolant side cup plates 82 can be easily identified. Therefore, it is possible to reduce the number of cases in which wrongly assembled, missing, and defective fluid side cup plates 80 and coolant side cup plates 82 are not caught.

Further, according to this example embodiment, the inner fins 94 that abut against the fluid side cup plates 80 and the coolant side cup plates 82 are provided inside the fluid flow layers 90, and the convex protrusions 96 that protrude out to the coolant flow layers 92 side and abut against the fluid side cup plates 80 are provided on the coolant side cup plates 82. As a result, the structures that perform heat exchange can be made to differ from one another with the fluid side cup plates 80 that form the fluid flow layers 90 and the coolant side cup plates 82 that form the coolant flow layers 92. Also, wrongly assembled fluid side cup plates 80 and coolant side cup plates 82, missing inner fins 94, and formation defects in the convex protrusions 96 can be easily identified. Accordingly, it is possible to reduce the number of cases in which missing inner fins 94 and deformation defects in the convex protrusions 96 are not caught.

Also, according to this example embodiment, the height in the stacking direction of the convex protrusions 96 of the coolant side cup plates 82 is set to a smaller value than the height in the stacking direction of the inner fins 94. Therefore, compared with when the inner fins 94 are provided inside the coolant flow layers 92 just as they are in the fluid flow layers 90, the height in the stacking direction of the heat exchanger 70 can be reduced and the heat exchanger 70 can be made that much smaller. For example, with a heat exchanger for fluid Fld (i.e., a transmission fluid cooler), the heat-exchange capability does not have to be as high as it does with a heat exchanger for engine oil. That is, not as much coolant needs to be circulated to the automatic transmission 110 side, so the flow path (i.e., the coolant flow layers 92) for the coolant Clt can be narrower than the flow path (i.e., the fluid flow layers 90) for the fluid Fld, and the convex protrusions 96 are used instead of the inner fins 94, so the heat exchanger 70 can be made that much smaller. Further, because the convex protrusions 96 are used instead of the inner fins 94, if the heat-exchange capability (i.e., heat-exchange performance and heat-transfer performance) is equivalent, the height of the convex protrusions 96 can be set to a smaller value than the height in the stacking direction of the inner fins 94, so the heat exchanger 70 can made smaller while ensuring the strength.

Hereinafter, example embodiments of the invention have been described in detail with reference to the drawings, but the invention may also be applied in other modes.

For example, in the example embodiment described above, the heat exchanger 70 is a transmission fluid cooler that performs heat exchange between the fluid Fld and the coolant Clt, but the invention is not limited to this. That is, the invention may be applied to any stacked vehicle heat exchanger capable of performing heat exchange between a first heat carrier and a second heat carrier. For example, the invention may also be applied to a stacked vehicle heat exchanger in which the first heat carrier is the coolant Clt and the second heat carrier is the fluid Fld, or a stacked vehicle heat exchanger in which the first heat carrier is coolant (or engine oil) and the second heat carrier is engine oil (or coolant), or the like.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A vehicle heat exchanger comprising a plurality of cup plates that are disposed such that a first layered space into which a first heat carrier is introduced and a second layered space into which a second heat carrier is introduced are disposed alternately between the plurality of cup plates when the plurality of cup plates are stacked, and peripheral end portions of the plurality of cup plates are fixed portions that are fixed together in a liquid-tight manner, the fixed portions being brazed sealed portions, wherein:

the heat exchanger is configured to perform heat exchange between the first heat carrier and the second heat carrier, wherein the first heat carrier is a transmission fluid and the second heat carrier is a coolant;

a distance in a stacking direction between a first cup plate, which is one of the plurality of cup plates, and a second cup plate, which is another one of the plurality of cup plates, and a distance in the stacking direction between the second cup plate and another first cup plate, which is another one of the plurality of cup plates, are set to different distances, the first cup plate and the second cup plate defining the first layered space, the second cup plate and the another first cup plate defining the second layered space; and end portions of outer wall portions of the cup plates are bent back so that a distance between the cup plates increases from the portions fixed together when the cup plates are stacked toward outer peripheral edges of the outer wall portions of the cup plates to define first and second spaces alternating between end portions of the first and second cup plates, wherein a thickness dimension of the first space is thicker than a thickness dimension of the second space, the first cup plate has a first hole portion, the second cup plate has a second hole portion, and the first hole portion and the second hole portion are configured as positioning holes alternately stacking the first cup plate and the second cup plate together, wherein a thickness dimension of the first layered space is thicker than a thickness dimension of the second layered space, in the stacking direction, and a shape of the first cup plate and a shape of the second cup plate are different from each other, and a fin is disposed only inside the first layered space so as to abut against each of the first cup plate and the second cup plate, a dimple shaped depression is provided on a first layered space side of the second cup plate, the dimple shaped depression protruding as a convex protrusion from a second layered space side of the second cup plate, the convex protrusion protrudes from the second cup plate only into the second layered space and abuts against the first cup plate, and wherein intervals in the stacking direction between the end portions of the outer wall portions of the stacked cup plates are predetermined irregular intervals.

2. A vehicle heat exchanger comprising:

a plurality of cup plates that are disposed such that a first layered space into which transmission fluid is introduced and a second layered space into which coolant is introduced are disposed alternately between the plurality of cup plates when the plurality of cup plates are stacked, and peripheral end portions of the plurality of cup plates are fixed portions that are fixed together in a liquid-tight manner, the fixed portions being brazed sealed portions;

wherein the heat exchanger is configured to perform heat exchange between the transmission fluid and the coolant, wherein the first heat carrier is a transmission fluid and the second heat carrier is a coolant;

a fin is disposed only inside the first layered space so as to abut against each of a first cup plate that defines the first layered space that introduces the transmission fluid and a second cup plate that defines the second layered space that introduces the coolant;

a dimple shaped depression is provided on a first layered space side of the second cup plate, the dimple shaped depression protruding as a convex protrusion from a second layered space side of the second cup plate, which protrudes from the second cup plate only into the second layered space and abuts against the first cup plate;

a height of the convex protrusion is smaller than a height of the fin, in a stacking direction, the first cup plate has a first hole portion, the second cup plate has a second hole portion, and the first hole portion and the second hole portion are configured as positioning holes alternately stacking the first cup plate and the second cup plate together, wherein a thickness dimension of the first layered space is thicker than a thickness dimension of the second layered space, in the stacking direction, and a shape of the first cup plate and a shape of the second cup plate are different from each other, and wherein intervals in the stacking direction between end portions of outer wall portions of the stacked cup plates are determined irregular intervals;

wherein end portions of outer wall portions of the CUP plates are bent back so that a distance between the CUP plates increases from the portions fixed together when the CUP plates are stacked toward outer peripheral edges of the outer wall portions of the CUP plates to define first and second spaces alternating between end portions of the first and second CUP plates, wherein a thickness dimension of the first space is thicker than a thickness dimension of the second space.

3. A vehicle heat exchanger comprising:

a plurality of first cup plates and a plurality of second cup plates, wherein:

the plurality of first cup plates and the plurality of second cup plates are alternately stacked;

a distance in a stacking direction between one of the first cup plates and one of the second cup plates that is adjacent to the one of the first cup plates and a distance in the stacking direction between the one of the second cup plates and another one of the first cup plates that is adjacent to the one of the second cup plates and is disposed on a side opposite to the one of the first cup plates in the stacking direction with respect to the one of the second cup plates are set to different distances; and end portions of outer wall portions of the cup plates are bent back so that a distance between the cup plates increases from portions fixed together when the cup plates are stacked toward outer peripheral edges of the outer wall portions of the cup plates to define first and second layered spaces alternating between the end portions of the first and second cup plates, wherein a thickness dimension of the first layered space is thicker than a thickness dimension of the second layered space, the first cup plate has a first hole portion, the second cup plate has a second hole portion, and the first hole portion and the second hole portion are configured as positioning holes alternately stacking the first cup plate and the second cup plate together, a fin is disposed only inside the first layered space so as to abut against each of the first cup plate and the second cup plate, and a dimple shaped depression is provided on a first layered space side of the second cup plate, the dimple shaped depression protruding as a convex protrusion from a second layered space side of the second cup plate, the convex protrusion protrudes from the second cup plate only into the second layered space and abuts against the first cup plate, wherein the plurality of first cup plates and the plurality of second cup plates are fixed together in a liquid tight manner at their peripheral edge portions, the peripheral edge portions being brazed sealed portions, and wherein the heat exchanger is configured to perform heat exchange between a transmission fluid and a coolant in the first and second layered spaces, and wherein intervals in the stacking direction between the outer peripheral edges of the stacked cup plates are predetermined irregular intervals.

* * * * *